United States Patent [19]

Hoeberechts

[11] Patent Number: 4,651,052

[45] Date of Patent: Mar. 17, 1987

[54] DEVICE FOR PICKING UP OR DISPLAYING IMAGES HAVING AN EXTERNALLY-MOUNTED SEMICONDUCTOR CATHODE

[75] Inventor: Arthur M. E. Hoeberechts, Eindhoven, Netherlands

[73] Assignee: U.S. Philips Corporation, New York, N.Y.

[21] Appl. No.: 754,188

[22] Filed: Jul. 10, 1985

Related U.S. Application Data

[63] Continuation of Ser. No. 469,352, Feb. 24, 1983, abandoned.

[30] Foreign Application Priority Data

Mar. 4, 1982 [NL] Netherlands ..... 8200875

[51] Int. Cl.[4] ..... H01J 29/04; H01J 29/46

[52] U.S. Cl. ..... 313/446; 313/346 R; 313/417

[58] Field of Search ..... 313/446, 409, 346 R, 313/482, 302, 456, 417, 237

[56] References Cited

U.S. PATENT DOCUMENTS 4,160,188 7/1979 Butterwick ..... 313/446

4,325,084 4/1982 van Gorkom et al. ..... 313/446 X

*Primary Examiner*—Stewart J. Levy

*Assistant Examiner*—Joseph W. Roskos

*Attorney, Agent, or Firm*—Robert T. Mayer; Steven R. Biren

[57] ABSTRACT

A device for picking up or displaying images includes a semiconductor device having at least one cold cathode. The semiconductor device is mounted to the outside of the device for picking up or displaying images by being fixed to a support having an opening to permit the passage of electrons from the semiconductor device to the interior of the devices for picking up or displaying images. This mounting configuration offers the advantages of simple cooling of the semiconductor device, direction connection of the semiconductor device, and improved electro-optical performance.

17 Claims, 7 Drawing Figures

DEVICE FOR PICKING UP OR DISPLAYING IMAGES HAVING AN EXTERNALLY-MOUNTED SEMICONDUCTOR CATHODE

This is a continuation of application Ser. No. 469,352, filed Feb. 24, 1983, now abandoned.

BACKGROUND OF THE INVENTION

The invention relates to a device for picking up or displaying images having means for controlling an electron beam and at least one semiconductor device which comprises at least one semiconductor cathode, having a semiconductor body, said semiconductor body being capable of emitting electrons at a main surface of the semiconductor body from at least one region of the body in the operating condition.

Such a device is known from the Dutch Patent Application No. 7905470 of the Applicant, laid open for public inspection on Jan. 15, 1981, which corresponds to U.S. Pat. No. 4,303,930.

The invention further relates to a semiconductor device for use in such a device.

A device of the aforementioned kind may also be used, for example, in electron microscopy or electron lithography. Such a device comprises means for controlling the electron beam so that it reaches an area at which in the case of electron microscopy and electron lithography respectively a preparation to be studied and a semiconductor body, which is covered, for example, with a photolacquer, respectively, can be arranged.

However, a device for picking up images usually comprises a cathode-ray tube, which acts as a camera tube in which as a target a photosensitive layer, such as, for example, a photoconducting layer, is present. In a device for displaying images, the device generally will comprise a cathode-ray tube which acts as a display tube, while a layer or a pattern of lines or dots of a fluorescent material is provided on a target.

The use of such devices provided with semiconductor cathodes may give rise to various problems.

A first problem involves the cooling of such cathodes. This cooling is difficult due to the fact that the semiconductor bodies are located in a vacuum during operation and are moreover generally secured on lead-through pins in the end wall of a glass tube. Due to the low heat conduction of these pins and the glass, a satisfactory removal to the exterior of the energy dissipated in the cathode is prevented.

Moreover, with an increasing number of emission points, the number of lead-through pins generally increases, because it is necessary that each emission point can be controlled separately. An increase in the number of lead-through pins renders the manufacturing process more difficult, while moreover the possibility of the occurrence of leakage and hence a less satisfactory vacuum increases. This may possibly be partly avoided by constructing the control arrangement of the cathodes in the form of an integrated circuit, preferably in the same semiconductor body in which the cathode is produced. However, the dissipation of such a circuit arrangement may again impose additional requirements on the cooling of the semiconductor body, which problems have been described above.

Moreover, a quite different problem occurs with the use of several emission points, which is of an electro-optical nature. In one of the embodiments of the Dutch Patent Application No. 7905470, a semiconductor body having three semiconductor cathodes is shown, which is provided on its lower side with a conducting contact, which contacts a p-type region which is common to the three cathodes. This common contact is connected, for example, to ground, while the separate contacts are controlled by means of positive voltages at contacts, which contact n-type surface regions forming part of the separate cathodes. These voltages must be positive enough with respect to ground that avalanche multiplication occurs in the associated p-n junction and the cathode consequently emits electrons. For example, due to resistance variation in the starting material (in the present example a p-type substrate) and in contact diffusions, these voltages may greatly differ for different cathodes. Inter alia dependent upon the extent to which electron multiplication is produced, the variation in one semiconductor body may be approximately 2 Volt so that electrons are emitted from different points on one main surface, while the n-type surface at one point has a potential of, for example, approximately 6 Volt, whereas at another point this potential is approximately 8 V.

In general, after having left the cathode, the electrons in an electron-optical system first traverse an accelerating electric field, for example, due to the fact that an accelerating grid or an accelerating electrode is located at a certain distance. If now the potential of such an accelerating electrode is 20 Volt, electrons emitted by one emission point traverse a potential difference of approximately 14 Volt, whereas electrons emitted by the other emission point traverse a potential difference of approximately 12 Volt. This means that, from an electro-optical point of view, they exhibit different behavior, which is undesirable. This phenomenon will occur to a greater extent when the various emission points are distributed over several semiconductor bodies.

From an electro-optical point of view, it is therefore desirable that all emissive surfaces have substantially the same potential, which is, for example, ground potential. In the semiconductor cathodes mentioned above, this may be achieved by connecting the emissive surface regions to each other, for example, through a highly doped n-type surface zone, as the case may be in combination with a metallization pattern. For controlling the separate p-n junctions (emission points), an additional deep highly doped p-type contact zone must then be provided for each emission point at the main surface in the semiconductor body. In order to avoid excessively high series resistances and, as the case may be, mutual influencing of adjacent emission points, the semiconductor body should moreover be provided with highly doped p-type buried layers extending from the p-type contact zone to substantially under the associated p-n junction.

Apart from the disadvantages of additional processing steps (p-type contact zones and buried layers), in such a solution the problem occurs that, because it is required that each emission point can be controlled individually, the number of lead-through pins in the cathode ray tube increases with the number of emission points. This in turn gives rise to the problems already described above of maintaining the vacuum in the cathode-ray tube and the cooling of the semiconductor body, respectively.

SUMMARY OF THE INVENTION

The invention has for its object to mitigate at least in part the aforementioned problems. It is based on the recognition of the fact that this can be achieved in that the semiconductor body is mounted in the device in a manner quite different from that known hitherto for semiconductor devices having cold cathodes.

A device according to the invention is therefore characterized in that the semiconductor body on the side of the main surface is fixed to a support, which is provided with an opening at the area of the region suitable for electron emission.

Such a device has various advantages. In the case of a cathode-ray tube, in which the support at the same time acts as an end wall, the semiconductor body is now situated outside the evacuated space. This, inter alia, simplifies considerably the heat dissipation from the semiconductor body. Moreover, by means of usual techniques, auxiliary electronic functions can additionally be realized on the support.

If the semiconductor body comprises several cathodes, these cathodes are preferably electrically independent of each other and provided with a common connection forming part of the regions suitable for electron emission. In this manner, the surface regions of different emission points can be brought to the same potential, for example, ground potential. This means that electrons from different emission points traverse a practically equal potential variation determined by the electro-optical system and the potential of the common connection. From electro-optical point of view, this is advantageous because variations in the emission behavior and hence in the electron path traversed are then avoided.

In order to be able to connect the emission regions to ground potential, especially when several semiconductor devices are present on the support, a preferred embodiment of a device according to the invention is characterized in that the means for fixing the semiconductor body to the support comprises an electrically conducting material, which is connected in an electrically conducting manner to a surface zone of the semiconductor cathode. Thus, a good electrical contact can be obtained and a substantially uniform potential is applied to the various surface regions.

The support may be manufactured of glass or of a ceramic material having a thickness varying between 0.2 mm and 5 mm.

A further preferred embodiment of a device according to the invention is characterized in that the other side of the support is provided around the opening in the support at least in part with at least one electrode.

Such an electrode acts as an accelerating electrode, as described in Dutch Patent Application No. 7800987, laid up for public inspection on July 31, 1979, which corresponds to U.S. Pat. No. 4,259,678. Alternatively, such an electrode may be split up for deflection purposes, as described in the not prepublished Dutch Patent Application No. 8104893, which corresponds to U.S. patent application Ser. No. 422,228.

A semiconductor device for use in a device according to the invention is characterized in that it comprises a semiconductor body which is provided at a main surface with a plurality of semiconductor cathodes, which are mutually electrically independent and which are capable of emitting electrons at a main surface of the body in the operating condition from a plurality of regions of the body and in that the cathodes are provided with a common connection for surface regions forming part of the regions suitable for electron emission.

Different emission mechanisms are possible. Thus, for example, use may be made of the phenomenon of avalanche multiplication of electrons, which occurs when a p-n junction is operated in the reverse direction at a sufficiently high voltage, as is described inter alia in the aforementioned Patent Application Nos. 7905470 and 7800987. The accelerating electrode shown therein may form part of the securing means, but may also be scanned, as already stated above, on the other side of the support, which as surprisingly has been found, does not lead to a considerably larger decrease of the efficiency of the cathode than when the accelerating electrode is disposed directly on an oxide layer, which is generally thinner than the support.

BRIEF DESCRIPTION OF THE DRAWING

The invention will now be described more fully with reference to several embodiments and the drawing, in which.

Figure 1:
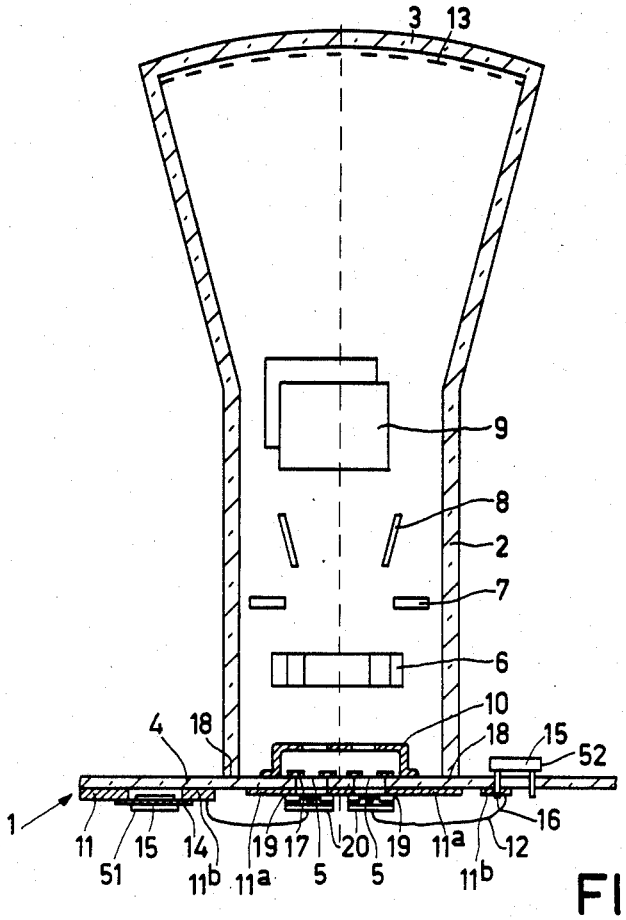
FIG. 1 shows diagrammatically a display tube comprising an arrangement according to the invention.

The Figures are not drawn to scale, and for the sake of clarity in the cross-sections the dimensions in the direction of thickness are greatly exaggerated. Semiconductor zones of the same conductivity type are generally hatched in the same direction; in the Figures, corresponding parts are generally designated by the same reference numerals.

DESCRIPTION OF THE PREFERRED EMBODIMENTS

FIG. 1 shows a device 1 according to the invention comprising a cathode-ray tube acting as a display tube. The hermetically sealed vacuum tube 2 ends in a funnel-shaped part, the end wall 3 being coated on the inner side with a fluorescent screen 13. The tube further comprises focusing electrodes 6, 7, deflection plates 8, 9 and a (screen) grid 10. The other end wall is constituted by a support 4 of, for example, a ceramic material having a thickness of 0.5 mm, which at the area of the semiconductor devices 20 is provided with openings 5. The semiconductor devices are located on the outer side of the cathode-ray tube and are fixed on the support 4 by means of a hermetic heat compression weld 19. The wall of the vacuum tube 2 is secured on the support 4 by means of a hermetic weld 18, which consists, for example, of a glass weld or a glass-metal weld. In this example, the weld 19 joins n-type surface zones 24 (see FIG. 2) of the semiconductor device 20 to metal tracks 11*a*, which are connected, for example, to ground. The connection 12 connects the semiconductor device 20 to a metallization pattern 11*b* on the support 4. Through the metallization pattern 11, the semiconductor device 20 is included in a circuit arrangement in which other circuit elements 15 are included. The circuit elements 15 are arranged in this example in a flat envelope 51 having co-planar conductors (flat pack) and in a ceramic or plastic envelope 52 (dual-inline package), in which event contact conductors contact the metallization pattern 11 through openings 16 in the support 4. On the inner side of the display tube provision is further made on the support 4 around the openings 5 of electrodes 17, which may act as accelerating electrodes or deflection electrodes, as is described in the Dutch Patent Application Nos. 7905470 and 8104893, the contents of which may be considered to be incorporated by reference in the present Application.

Figure 2:
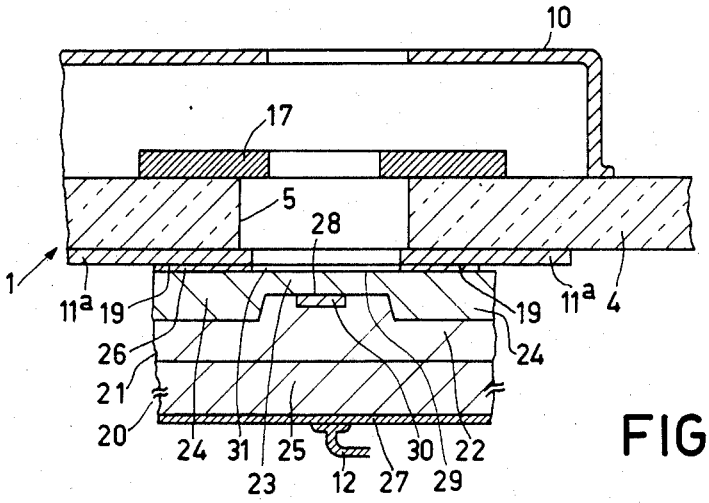
FIG. 2 shows diagrammatically a detail of FIG. 1.

The semiconductor device 20 comprises one or more semiconductor cathodes of the avalanche breakdown type. FIG. 2 shows a detail of the arrangement of FIG. 1, in which such a semiconductor device is illustrated in cross-section. The semiconductor device 20 comprises a semiconductor body 21 having a p-type substrate 25 on which a p-type surface layer 22 is grown epitaxially. For a good connection, the semiconductor body further comprises highly doped n-type contact zones 24 for a contact 26. The substrate is contacted by a contact 27. The p-n junction 28 between the n-type region 23 and the p-type layer 22 is operated in the reverse direction during use so that electrons are generated by avalanche multiplication which can emanate from the semiconductor body at the surface 29. Due to the fact that at the area of the p-type region 30, which forms inside the opening 5 with the region 23 a part of the p-n junction 28, the breakdown voltage is lower than at other areas, breakdown will occur here earlier and the electron emission will be obtained mainly at the area of this region of reduced breakdown voltage. The surface 29 is moreover provided inside the opening 5 with a material 31 reducing the work function, such as caesium or barium. For a more extensive description of such cathodes and their operation, reference is made to the aforementioned Dutch Patent Application No. 7905470.

The contact 26, which surrounds the emissive surface, for example, in the form of a ring, is fixed by means of thermal compression in a vacuum-tight manner on the metallization pattern 11 on the support 4. Thus, the weld 19 is obtained. The support 4 is provided with a circular opening 5 at the area of the emissive surface. The other side of the support 4 is provided with an electrode 17, which in the present example also has the form of a ring and acts as an accelerating electrode.

In the embodiment according to FIGS. 1 and 2, the two semiconductor bodies 21 are connected through contacts 26 to a common metallization pattern 11*a*, which is connected, for example, to ground. As a result, the surfaces 29 of the two semiconductor devices are also substantially at this potential, so that from the cathodes the electrons leave the surface 29 under substantially identical conditions, i.e. an accelerating field to be traversed, the first part of which is practically completely determined by the accelerating electrode (for example, the electrode 17).

Due to the fact that the semiconductor body is not situated in the vacuum itself, but on the outer side of the cathode-ray tube, the energy dissipated in the semiconductor body can be easily dissipated.

Thus, the support 4 acts, as it were, as a very efficient cooling fin. Alternatively, if desired, cooling fins in the form of pressure or contact springs may be disposed against the metallization layer 27.

In order to protect the semiconductor bodies and in particular the wiring circuit 12, the assembly can be covered with a hood, which may be filled with a heat conducting electrically insulating paste. If required, a vacuum may be present in this hood, for example, if the weld 19 need not be vacuum-tight, as may be the case, for example, in applications for electron microscopy.

Another advantage of such an arrangement is that the semiconductor device 20 can be included in a simple manner in a control circuit, which is formed on the support 4 with the aid of the circuit element 15. One contact 26 of the cathode has already been included in such a circuit arrangement through the weld 19 and the metallization pattern 11*a*, while the connection wire 12 secured on the contact 27 may be connected elsewhere to the pattern 11.

The device 20 shown in FIG. 1 may be formed, if desired, in one semiconductor body. The support 4, which acts as an end wall and which is flat in the present example, may then be slightly curved within certain limits, which from an electro-optical point of view may be favorable in connection with possibilities then obtained to correct image aberrations.

Figure 3:
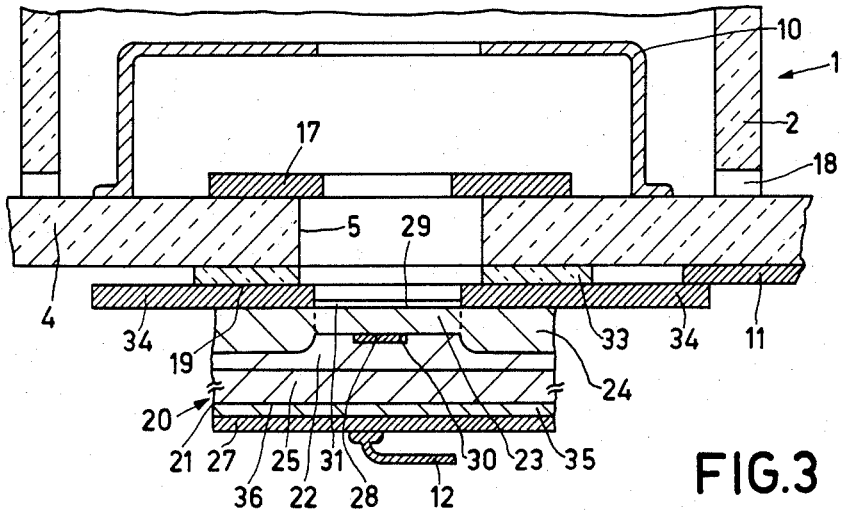
FIG. 3 shows diagrammatically a modification of the arrangement of FIG. 2.

In the arrangement of FIG. 3, the metal weld 19 is replaced by a seal 33 of hermetically sealing insulating material, such as, for example, glass or glue, while the connection between the contact zone 24 and the metallization pattern 11 is now constituted by a freely supporting conducting surface 34, which contacts the zone 24.

The screen grid 10 is then mounted, for example, with a laser weld on the support 4, while the tube 2 is fixed on the support 4 with a vacuum-tight weld by means of usual techniques, such as, for example, a heat compression weld.

Otherwise, the reference numerals have the same meaning as in FIG. 2, except the n-type region 35. By diffusing this n-type region into the p-type region 25 in the arrangement of FIG. 2, the action of the cathode is not lost, for during operation the p-n junction 36 between the n-type region 35 and the p-type substrate 25 is operated in the forward direction. On the other hand, however, when the connection 12 is positive with respect to that of the region 24, the p-n junction 35 conveys an avalanche current over a large part of the associated surface. The dissipation connected therewith is such that the semiconductor device may serve, if desired, as a bake-out element in order to attain a good vacuum in the tube 2 or in a larger space, for example, when an arrangement according to the invention is accommodated entirely in a larger vacuum space.

Figure 4:
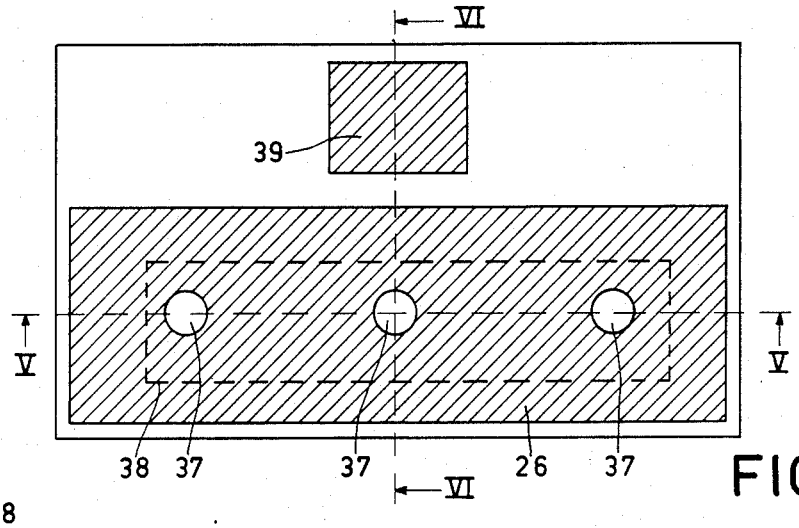
FIG. 4 shows diagrammatically in plan view a semiconductor device for use in an arrangement according to the invention.
Figure 5:
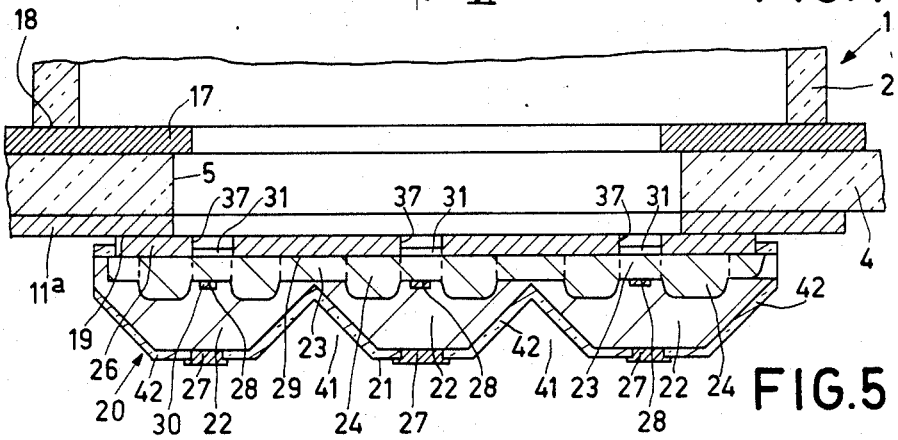
FIG. 5 and FIG. 6 show diagrammatically cross-sections taken on the lines V—V and VI—VI, respectively, in FIG. 4 a detail of such a device.
Figure 6:
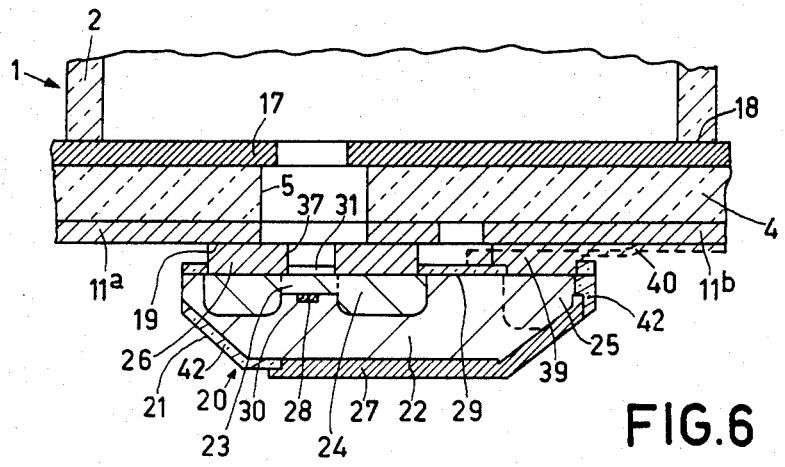

In the device according to FIGS. 4, 5 and 6, different semiconductor cathodes are formed in one semiconductor body 21. The emissive regions are indicated in the plan view of the semiconductor device by circular openings 37 in the common contact metallization 26, while the region left free through the opening 5 in the support 4 is indicated by the broken line 38 (FIG. 4). If the contact metallization 26 is connected to ground, the entire surface layer 23 is again practically at the same potential, which from an electro-optical point of view has the aforementioned advantages.

The different semiconductor cathodes with emitting p-n junctions 28 are mutually separated by means of V-shaped grooves 41, which extend into the common n-type surface layer 23 and thus insulate the cathodes. In the present example, the silicon surface is coated in the grooves with an oxide layer 42; if desired, the grooves may be filled entirely with, for example, polycrystalline silicon. The contacts metallization 27, which contact the p-type regions 22, may again be connected through a wire to the metallization pattern 11 on the support 4. In the present example, a contact is formed at the surface 29 by means of a deep $p^+$-contact diffusion 25 and a contact metallization 39; the contact metallization 39 may again be secured directly through a weld on the metallization pattern 11*b*. The metallization layer 27 in this example serves as a low-ohmic connection between the given emissive region controlled by a contact 39 and the highly doped p-type contact zone 25 at the area of this contact 39. Instead of through a direct connection, the contact 39 may also be connected to the pattern 11*b* through a freely supporting connection (beam-lead), indicated in FIG. 6 by the dotted line 40. Otherwise, the reference numerals again have the same meaning as in the preceding Figures; for the sake of clarity, other elements of the cathode-ray tube than the wall 2 are not shown.

Figure 7:
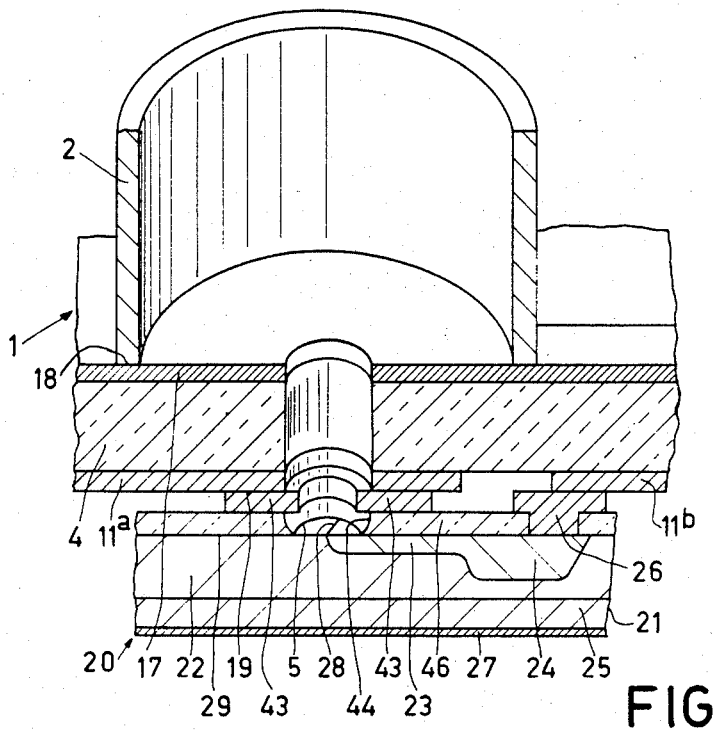
FIG. 7 shows a part of a still further modification of an arrangement according to the invention.

FIG. 7 shows an embodiment in which the vacuum-tight weld 19 between the metallization 11 and the semiconductor device is formed between the metallization 11 and an accelerating electrode 43, which is located on the semiconductor body around an opening 44 and is separated from the semiconductor body by an oxide layer 46; such a semiconductor cathode, in which the p-n junction 28 used for emission intersects the surface 29, is described in the aforementioned Dutch Patent Application No. 7800987.

In order to be able to connect the n-type region 23, the arrangement is provided with a contact metallization 26, which contacts a pattern 11*a* on the support 4. Otherwise, the reference numerals again have the same meaning as in the preceding Figures.

It stands to reason that the invention is not limited to the examples described above, but that within the scope of the invention many modifications are possible for those skilled in the art. Thus, for example, the weld 19 need not always be vacuum-tight, for example, when the support with the semiconductor device provided thereon forms part of a larger assembly, which is evacuated, as in the case of an electron microscope or with lithographic applications.

Instead of by insulation by means of V-shaped grooves, in FIG. 5 the cathodes may also be mutually separated by means of local oxidation. At the main surface 29, if required, other semiconductor elements may be realized for various purposes, as is usual in the semiconductor technology.

Furthermore, the arrangement is not limited to cathodes in which the emission is brought about by means of breakdown, but cathodes with various other emission mechanisms may be utilized.

What is claimed is:

1. A device for picking up or displaying images having an internally-evacuated portion and comprising means for controlling an electron beam and at least one semiconductor device which comprises at least one semiconductor cathode, said semiconductor device having a semiconductor body, said semiconductor body being capable of emitting electrons at a main surface of the body from at least one region of the body in the operating condition, characterized in that the semiconductor body, on the side of the main surface, is fixed to the outside of said internally-evacuated portion of the device for picking up or displaying images by a support which at the area of the region suitable for electron emission is provided with an opening.

2. A device as claimed in claim 1, characterized in that the semiconductor device comprises a plurality of semiconductor cathodes, which are mutually electrically independent and are provided with a common connection for the surface regions forming part of the regions suitable for electron emission.

3. A device as claimed in claim 1 or 2, characterized in that the semiconductor body is fixed to the support by a layer of conducting material on the semiconductor body, which is provided with windows at the area of the regions suitable for electron emission.

4. A device as claimed in claim 1 or 2, characterized in that the semiconductor body is fixed to the support by an electrically conducting material, which is connected in an electrically conducting manner to a surface zone of the semiconductor device.

5. A device as claimed in claim 3 characterized in that the support is provided on the side of of the semiconductor body with an electrically conducting track, which electrically contacts the conducting material of the securing means.

6. A device as claimed in claim 1 or 2, characterized in that the semiconductor body is secured to the support in a vacuum-tight manner and the device is further provided with a target in an evacuated cathode-ray tube, which is secured in a vacuum-tight manner on the other side of the support.

7. A device as claimed in claim 1 or 2, characterized in that the other side of the support than that on which the semiconductor device is fixed is provided at least in part around the opening in the support with at least one electrode.

8. A device as claimed in claim 1 or 2, characterized in that the thickness of the support is at most 10 mm.

9. A device as claimed in claim 8, characterized in that the thickness of the support lies between 0.2 mm and 5 mm.

10. A device as claimed in claim 1 or 2, characterized in that the support is made of glass or of a ceramic material.

11. A device as claimed in claim 2, characterized in that the semiconductor cathodes are electrically separated from each other by means of grooves.

12. A device as claimed in claim 11, characterized in that the grooves are filled with an electrically insulating material.

13. A semiconductor device as claimed in claim 1 or 2 comprising a semiconductor body with a plurality of semiconductor cathodes, which are mutually electrically independent, and in that the cathodes are provided with a common connection to surface regions forming part of the regions suitable for electron emission.

14. A semiconductor device as claimed in claim 13, characterized in that each semiconductor cathode in the semiconductor body comprises a p-n junction between an n-type region adjoining a surface of the semiconductor body and a p-type region, in which, by the application of a voltage in the reverse direction across the p-n junction in the semiconductor body, electrons are generated by avalanche multiplication, which can emanate from the semiconductor body.

15. A semiconductor device as claimed in claim 14, characterized in that the p-type region is contacted by means of an injecting p-n junction.

16. A semiconductor device as claimed in claim 14 or 15, characterized in that several p-type surface regions are connected to each other through one or more n-type surface regions and different semiconductor cathodes are mutually insulated by grooves, which extend from the opposite surface into the n-type surface regions.

17. A semiconductor device as claimed in claim 16, characterized in that the grooves are filled with an electrically insulating material.

* * * * *